US010487692B2

(12) United States Patent
Ono et al.

(10) Patent No.: US 10,487,692 B2
(45) Date of Patent: Nov. 26, 2019

(54) STEAM TURBINE

(71) Applicants: KABUSHIKI KAISHA TOSHIBA, Minato-ku (JP); Toshiba Energy Systems & Solutions Corporation, Kawasaki-shi (JP)

(72) Inventors: Takahiro Ono, Ota (JP); Tsuguhisa Tashima, Yokohama (JP); Shogo Iwai, Ota (JP); Daichi Fukabori, Yokohama (JP)

(73) Assignees: KABUSHIKI KAISHA TOSHIBA, Minato-ku (JP); Toshiba Energy Systems & Solutions Corporation, Kawasaki-shi (JP)

( * ) Notice: Subject to any disclaimer, the term of this patent is extended or adjusted under 35 U.S.C. 154(b) by 156 days.

(21) Appl. No.: 15/818,859

(22) Filed: Nov. 21, 2017

(65) Prior Publication Data

US 2018/0142574 A1 May 24, 2018

(30) Foreign Application Priority Data

Nov. 24, 2016 (JP) ..... 2016-228282

(51) Int. Cl.

| | |
|---|---|
| ***F01D 25/26*** | (2006.01) |
| ***F01D 25/28*** | (2006.01) |
| ***F01D 25/16*** | (2006.01) |
| ***F01D 25/30*** | (2006.01) |

(52) U.S. Cl.

CPC ..... *F01D 25/28* (2013.01); *F01D 25/162* (2013.01); *F01D 25/26* (2013.01); *F01D 25/30* (2013.01); *F05D 2220/31* (2013.01); *F05D 2260/30* (2013.01)

(58) Field of Classification Search

CPC ..... F01D 25/26; F01D 25/28

See application file for complete search history.

(56) References Cited

U.S. PATENT DOCUMENTS 3,773,431 A * 11/1973 Bellati ..... F01D 25/26 415/108

3,843,281 A * 10/1974 Meylan ..... F01D 25/28 415/213.1

(Continued)

FOREIGN PATENT DOCUMENTS

| | | | |
|---|---|---|---|
| JP | 2012-112254 | A | 6/2012 |
| JP | 5642514 | B2 | 12/2014 |
| JP | 2015-124634 | A | 7/2015 |

*Primary Examiner* — Ninh H. Nguyen

(74) *Attorney, Agent, or Firm* — Oblon, McClelland, Maier & Neustadt, L.L.P.

(57) ABSTRACT

A steam turbine according to an embodiment includes an outer casing; an inner casing housed in the outer casing; a turbine rotor penetrating the inner casing and the outer casing; and a supporting beam provided inside the outer casing. The supporting beam extends in an axial direction of the turbine rotor and supports the inner casing. The outer casing includes outer casing supporting portions which are provided at both ends of the outer casing in the axial direction and are supported by the foundation. The supporting beam has beam end portions provided at both ends in the axial direction. Each of the outer casing supporting portions includes a supporting surface that supports the corresponding beam end portion.

8 Claims, 9 Drawing Sheets

(56) References Cited

U.S. PATENT DOCUMENTS 3,881,843 A * 5/1975 Meylan ..... F01D 25/28
415/213.1
5,779,435 A * 7/1998 Lageder ..... F01D 25/24
184/106

* cited by examiner

STEAM TURBINE

CROSS-REFERENCE TO RELATED APPLICATIONS

This application is based upon and claims the benefit of priority from Japanese Patent Application No. 2016-228282, filed on Nov. 24, 2016; the entire contents of which are incorporated herein by reference.

FIELD

An embodiment of the present invention relates to a steam turbine.

BACKGROUND

A steam turbine plant is mainly provided with a high-pressure steam turbine in which main steam performs work; an intermediate-pressure steam turbine in which reheated steam performs work; and a low-pressure steam turbine in which steam discharged from the intermediate-pressure steam turbine performs work. Among these steam turbines, the low-pressure steam turbine is coupled to a condenser, and the steam discharged from the low-pressure steam turbine is condensed in the condenser so as to generate condensate.

An outer casing of a low-pressure steam turbine is a pressure vessel. From a viewpoint of ease in assembly and disassembly, the outer casing is divided into two parts, an outer casing upper half and an outer casing lower half, by a horizontal plane including a shaft center line of a turbine rotor. A flange of the outer casing upper half and a flange of the outer casing lower half are fastened to each other with a bolt and the like. A foot plate is provided to a side surface close to the flange of the outer casing lower half. This foot plate is fixed to a foundation, and the outer casing is supported on the foundation by the foot plate.

An outer portion of the outer casing in the low-pressure steam turbine is exposed to the atmosphere, while an inner portion thereof is caused to be in a vacuum state by the condenser. Accordingly, the outer casing receives a load due to a difference between pressure applied to an outer surface and pressure applied to an inner surface. Typically, this load is called a vacuum load. When receiving a vacuum load, the outer casing may deform to recess inward. Therefore, an inner casing supported by the outer casing lower half may be displaced as being affected by deformation of the outer casing due to the vacuum load.

On the other hand, the turbine rotor is rotatably supported by a rotor bearing. This rotor bearing is supported by a bearing base. A cone is provided to a central part of an end plate of the outer casing. This cone protrudes from the end plate toward the inside of the outer casing. The bearing base is typically supported by this cone. Therefore, when the rotor bearing receives a load from the turbine rotor, the load is transferred to the outer casing through the bearing base, which may deform the outer casing. Accordingly, the rotor bearing may be displaced. Furthermore, since the bearing base is supported by the outer casing, there is a possibility that the rotor bearing may be displaced by deformation of the outer casing due to the vacuum load.

In this manner, displacement of the rotor bearing may lead to displacement of the turbine rotor as a rotary unit. As described above, the inner casing as a stationary unit may be displaced due to an influence deformation of the outer casing due to the vacuum load or the load from the turbine rotor.

Therefore, in consideration of the aforementioned positional displacement, it is difficult to reduce a gap between the rotary unit and the stationary unit in order to prevent contact between the rotary unit and the stationary unit. Such a case increases detriment attributable to steam leaking from between the rotary unit and the stationary unit, which may degrade performance of the turbine.

DETAILED DESCRIPTION

A steam turbine according to an embodiment is a steam turbine provided on a foundation. This steam turbine includes an outer casing; an inner casing housed in the outer casing; a turbine rotor penetrating the inner casing and the outer casing; and a supporting beam provided inside the outer casing, the supporting beam extending in an axial direction of the turbine rotor and supporting the inner casing. The outer casing includes outer casing supporting portions which are provided at both ends of the outer casing in the axial direction and are supported by the foundation. The supporting beam has beam end portions provided at both ends in the axial direction. Each of the outer casing supporting portions includes a supporting surface that supports the corresponding beam end portion.

Hereinafter, a steam turbine according to an embodiment of the present invention will be described with reference to the drawings.

First Embodiment

A steam turbine according to a first embodiment will be described with reference to FIGS. 1 to 8. The steam turbine illustrated in the present embodiment is a low-pressure steam turbine coupled to a condenser, serving as a lower exhaust turbine configured to discharge steam downward toward the condenser. The low-pressure steam turbine is disposed on a foundation F.

Figure 1:
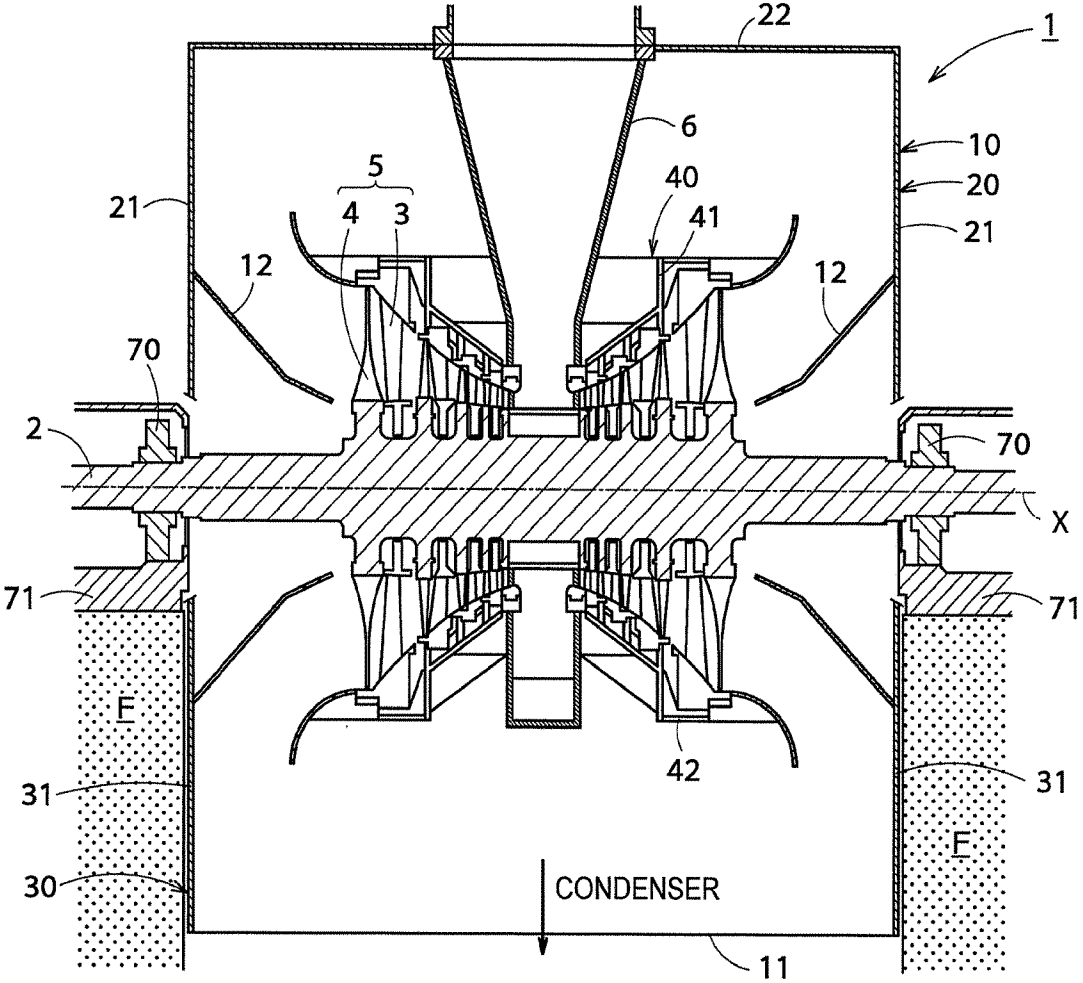
FIG. 1 is a vertical cross-sectional view illustrating a general arrangement of a steam turbine according to a first embodiment.
Figure 2:
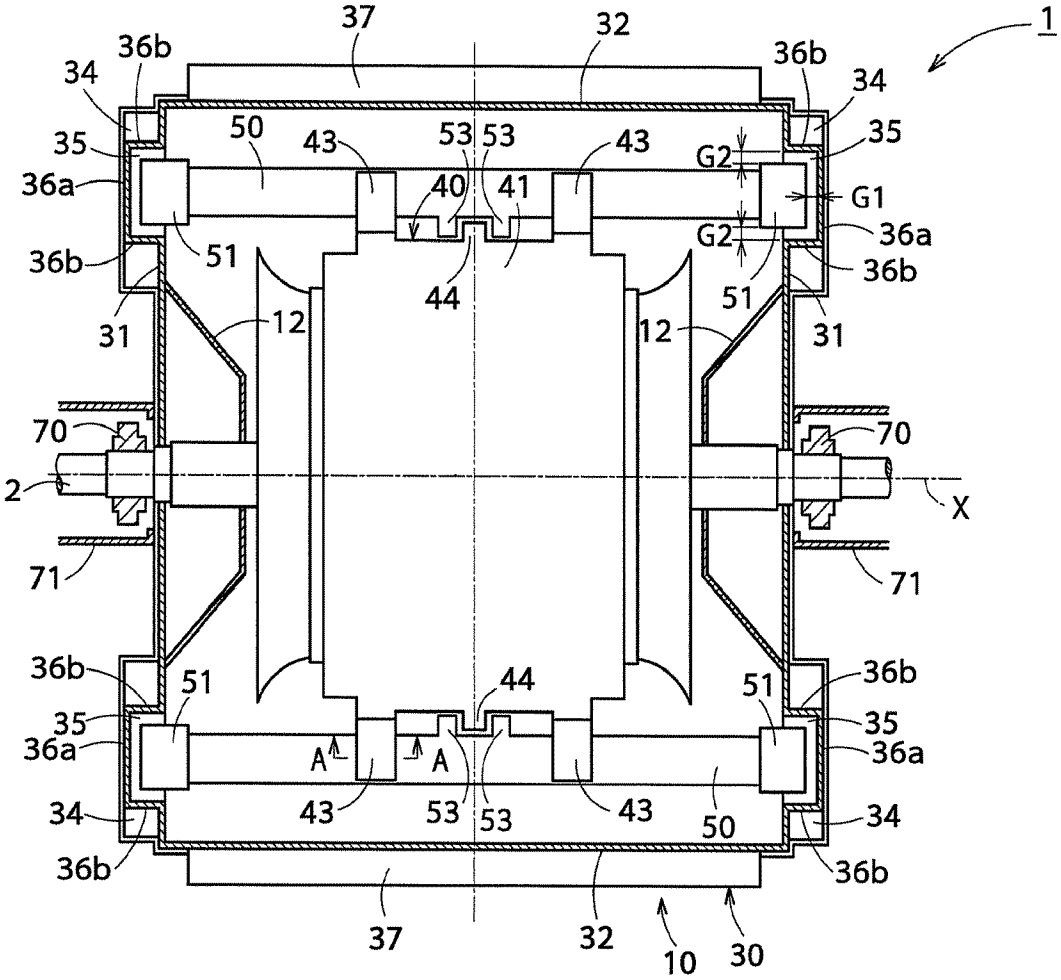
FIG. 2 is a horizontal cross-sectional view illustrating the steam turbine of FIG. 1.

As illustrated in FIGS. 1 and 2, a low-pressure steam turbine 1 (hereinafter simply referred to as a "steam turbine 1") includes an outer casing 10, an inner casing 40 housed in the outer casing 10, and a turbine rotor 2 penetrating the inner casing 40 and the outer casing 10. Among these components, the inner casing 40 is provided with a plurality of nozzle diaphragms 3. The plurality of nozzle diaphragms 3 is separated from each other in an axial direction of the turbine rotor 2. Mainly, the inner casing 40 and the nozzle diaphragms 3 are included in a stationary unit of the steam turbine 1. The turbine rotor 2 is provided with a plurality of rotor blades 4. The plurality of rotor blades 4 is separated from each other in the axial direction of the turbine rotor 2. Mainly, the turbine rotor 2 and the rotor blades 4 are included in a rotary unit of the steam turbine 1. Note that the axial direction of the turbine rotor 2 indicates a direction in which a shaft center line X of the turbine rotor 2 extends (a left-and-right direction in FIGS. 1 and 2).

The nozzle diaphragms 3 and the rotor blades 4 are alternately arranged. One nozzle diaphragm 3 and one rotor blade 4 adjacent to this nozzle diaphragm 3 in a lower stream are included in one turbine stage 5. In the steam turbine 1 illustrated in FIG. 1, such a turbine stage 5 is provided plurally.

To the inner casing 40, a steam supply pipe 6 is connected. The steam supply pipe 6 guides steam supplied from an intermediate-pressure steam turbine or a boiler (not illustrated) to the turbine stage 5 in the uppermost stream. The steam then passes through each turbine stage 5 to perform work. Accordingly, the turbine rotor 2 is driven to rotate, and an electric generator (not illustrated) coupled to the turbine rotor 2 generates electricity.

The steam turbine 1 according to the present embodiment is a lower exhaust turbine as described above. In other words, the outer casing 10 includes a lower exhaust outlet 11 provided to a lower end of the outer casing 10. The outer casing 10 is also provided with cones 12 to guide the steam that has passed through each turbine stage 5 to the lower exhaust outlet 11. The cones 12 are formed so as to protrude toward the inside of the outer casing 10 from an upper half end plate 21 and a lower half end plate 31 which are to be mentioned. In this manner, the steam that has passed through each turbine stage 5 flows through the inside of the outer casing 10 toward the lower exhaust outlet 11 so as to be discharged from the lower exhaust outlet 11. The steam discharged from the lower exhaust outlet 11 is supplied to a condenser (not illustrated) coupled to the steam turbine 1, being condensed in the condenser so as to generate condensate.

Figure 3:
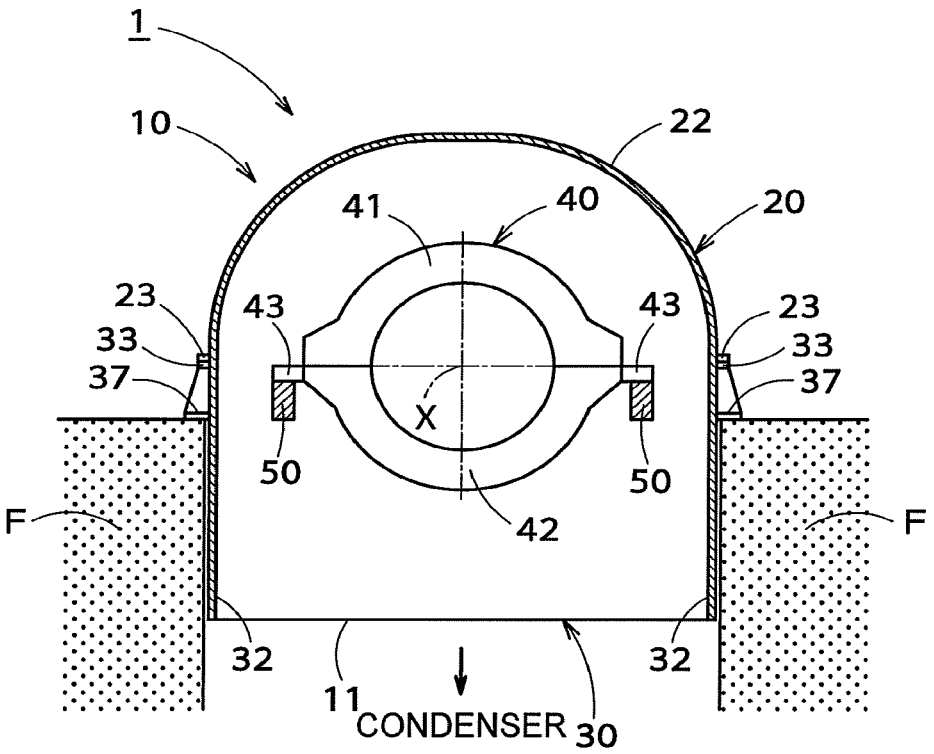
FIG. 3 is a cross-sectional side view illustrating the steam turbine of FIG. 1.

As illustrated in FIGS. 1 and 3, the outer casing 10 has an outer casing upper half 20 and an outer casing lower half 30. The outer casing 10 is divided into two in a vertical direction by a horizontal plane including the shaft center line X of the turbine rotor 2.

The outer casing upper half 20 includes a pair of upper half end plates 21 provided at both ends in the axial direction of the turbine rotor 2; a body of outer casing upper half 22 provided between the pair of upper half end plates 21; and an upper half flange 23. Among these components, the body of outer casing upper half 22 is formed in a half cylindrical shape, extending in the axial direction of the turbine rotor 2. The upper half flange 23 is continuously provided to lower ends of the upper half end plates 21 and a lower end of the body of outer casing upper half 22.

The outer casing lower half 30 is formed in a rectangular tube shape, extending in the vertical direction as a whole. The outer casing lower half 30 includes a pair of lower half end plates 31 provided at both ends in the axial direction of the turbine rotor 2; and a pair of lower half body plates 32 provided between the pair of lower half end plates 31. A lower half flange 33 is continuously provided to upper ends of the lower half end plates 31 and upper ends of the lower half body plates 32.

The upper half flange 23 of the outer casing upper half 20 and the lower half flange 33 of the outer casing lower half 30 are fastened to each other with a bolt and the like. Accordingly, the outer casing upper half 20 and the outer casing lower half 30 are combined.

As illustrated in FIG. 2, the outer casing lower half 30 of the present embodiment further includes a first foot plate 34 (outer casing supporting portion) provided to each of the lower half end plates 31. The first foot plates 34 are supported by the foundation F provided around the outer casing 10. More specifically, the first foot plates 34 are fixed to the foundation F to support the outer casing 10 on the foundation F. The first foot plates 34 are disposed on both sides with respect to the shaft center line X of the turbine rotor 2 as viewed from above. In the present embodiment, the outer casing lower half 30 includes four first foot plates 34.

As illustrated in FIG. 2, a pair of supporting beams 50 is provided inside the outer casing 10 to support the inner casing 40. The supporting beams 50 extend in the axial direction of the turbine rotor 2 at a height close to the shaft center of the turbine rotor 2 (more specifically, they are parallel and horizontal to the shaft center line X of the turbine rotor 2). In other words, the supporting beams 50 have a longitudinal direction along the axial direction of the turbine rotor 2. In the present embodiment, the supporting beams 50 are disposed on both sides with respect to the shaft center line X of the turbine rotor 2 when viewed from above (both sides in the vertical direction in FIG. 2), being arranged close to the inner casing 40. More specifically, as viewed from above, the supporting beams 50 are disposed between the inner casing 40 and the lower half body plates 32 of the outer casing lower half 30, being arranged closer to the inner casing 40 than the lower half body plates 32.

Figure 4:
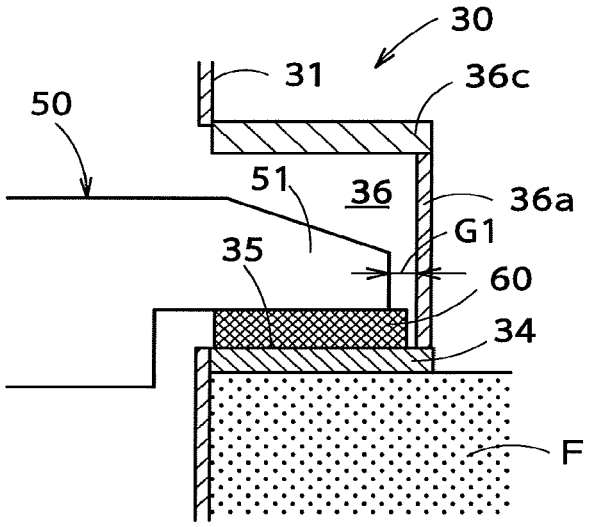
FIG. 4 is a partially enlarged cross-sectional view illustrating a beam end portion of a supporting beam illustrated in FIG. 2.

Each of the supporting beams 50 has beam end portions 51 provided at both ends in the axial direction of the turbine rotor 2. As illustrated in FIGS. 2 and 4, each of the first foot plates 34 includes a supporting surface 35 (an upper surface of each first foot plate 34) that supports the corresponding beam end portion 51. In the present embodiment, each of the beam end portions 51 is placed on the supporting surface 35 of the corresponding first foot plate 34. Accordingly, the supporting beams 50 are positioned at a height based on a foundation surface (an upper surface of the foundation F). Each of the beam end portions 51 is disposed on the corresponding supporting surface 35 slidably in the axial direction of the turbine rotor 2.

More specifically, as illustrated in FIGS. 2 and 4, an end housing space 36 is provided above each first foot plate 34 to house the corresponding beam end portion 51. The outer casing lower half 30 further includes first end walls 36*a*, pairs of second end walls 36*b*, and ceiling walls 36*c*. Each end housing space 36 is sectioned by the first foot plate 34, the first end wall 36*a*, a pair of second end walls 36*b*, and the ceiling wall 36*c*. Further, the end housing spaces 36 are formed into a recess with respect to an internal space of the outer casing 10 (in other words, they are formed into a projection protruding outward from the lower half end plates 31). Each first end wall 36*a* faces the corresponding beam end portion 51 in the axial direction of the turbine rotor 2. Each second end wall 36*b* faces the corresponding beam end portion 51 in a direction orthogonal to the axial direction of the turbine rotor 2 as viewed from above (hereinafter referred to as an "axis-orthogonal direction"). Each ceiling wall 36*c* is coupled to an upper end of the first end wall 36*a* and an upper end of the second end wall 36*b* so as to face the corresponding supporting surface 35. The supporting surfaces 35, the second end walls 36*b*, and the ceiling walls 36*c* are coupled to the lower half end plates 31. In this manner, the end housing spaces 36 are formed into a rectangular space, being configured to house the beam end portions 51. The first foot plates 34 are disposed on upper parts of the lower half end plates 31, but it should be noted that the first foot plates 34 are disposed at a position so as to form the end housing spaces 36 at positions lower than the lower half flange 33.

As illustrated in FIGS. 2 and 4, a gap G1 is provided between each beam end portion 51 and the corresponding first end wall 36*a*. In this manner, each beam end portion 51 is configured not to be in contact with the first end wall 36*a*. The gap G1 is set to such a size that each beam end portion 51 does not come into contact with the first end wall 36*a* even when the outer casing 10 deforms due to a vacuum load or a load of the turbine rotor 2. Furthermore, a gap G2 is also provided between each beam end portion 51 and the corresponding pair of second end walls 36*b* so that each beam end portion 51 does not come into contact with the second end walls 36*b*. Similar to the gap G1, the gap G2 is set to such a size that each beam end portion 51 does not come into contact with the second end walls 36*b* even when the outer casing 10 deforms.

As illustrated in FIG. 4, in the present embodiment, a low friction member 60 is interposed between each beam end portion 51 and the corresponding supporting surface 35. The low friction members 60 may be made of a low friction material such as Teflon (registered trademark), but is not limited thereto. For example, the low friction members 60 may be totally formed of a low friction material. Alternatively, the low friction members 60 may have a structure in which a metallic surface (at least an upper surface) shaped like a baseplate is coated with a low friction material.

As illustrated in FIGS. 1 and 3, the inner casing 40 includes an inner casing upper half 41 and an inner casing lower half 42. In other words, the inner casing 40 is divided into two in the vertical direction by the horizontal plane including the shaft center line X of the turbine rotor 2. As illustrated in FIGS. 2 and 3, the inner casing lower half 42 has four arms 43 supported by the supporting beams 50. The arms 43 extend in the axis-orthogonal direction, being formed to protrude outward from an upper end of the inner casing lower half 42. In the present embodiment, as illustrated in FIG. 2, two arms 43 are provided on each side with respect to the shaft center line X of the turbine rotor 2 as viewed from above.

Figure 5:
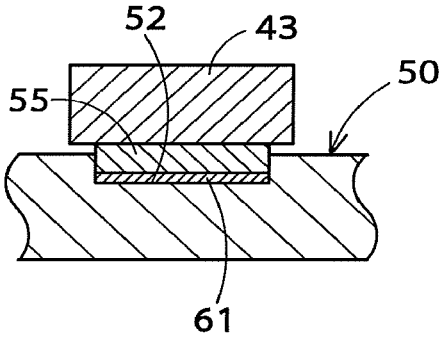
FIG. 5 is a cross-sectional view taken along the line A-A in FIG. 2.

As illustrated in FIG. 5, in the present embodiment, each supporting beam 50 has a beam groove 52 that opens upward. The beam groove 52 is where a seat 55 is inserted. The arms 43 are placed on this seat 55. An upper surface of the seat 55 is disposed above upper surfaces of the supporting beams 50 so that the arms 43 do not come into contact with the supporting beams 50. In this manner, the arms 43 are disposed slidably with respect to the seat 55.

At least one shim 61 is interposed between the seat 55 and a bottom surface of the beam groove 52. In this manner, as a thickness of the shim 61 or the number thereof is adjusted in accordance with deflection of the supporting beams 50, it is possible to adjust a height of the inner casing 40. Therefore, a shaft center of the stationary unit can be aligned with a shaft center of the rotary unit in the vertical direction.

As illustrated in FIG. 2, the supporting beams 50 are restricted to move in the axial direction with respect to a central part of the inner casing 40 in the axial direction of the turbine rotor 2. More specifically, the inner casing lower half 42 includes inner casing regulating portions 44. The inner casing regulating portions 44 are provided on both sides with respect to the shaft center line X of the turbine rotor 2 as viewed from above. The inner casing regulating portions 44 are disposed between the pair of arms 43 as viewed from above. More specifically, the inner casing regulating portions 44 are disposed in central positions of the inner casing 40 in the axial direction of the turbine rotor 2. Both sides in the axial direction of each inner casing regulating portion 44 are provided with portions to be regulated 53 of each supporting beam 50 so that the supporting beams 50 are restricted to move with respect to the inner casing 40 in the axial direction.

As illustrated in FIGS. 2 and 3, the outer casing lower half 30 further includes a second foot plate 37 provided on an outer surface of each lower half body plate 32. The second foot plates 37 are supported by the foundation F provided around the outer casing 10. More specifically, the second foot plates 37 are fixed to the foundation F to support the outer casing 10 on the foundation F. The second foot plates 37 are disposed at both sides with respect to the shaft center line X of the turbine rotor 2 as viewed from above, being disposed at a height similar to the first foot plates 34.

As illustrated in FIGS. 1 and 2, the turbine rotor 2 is rotatably supported by rotor bearings 70. The rotor bearings 70 are supported by a bearing base 71, and the bearing base 71 is supported by the foundation F provided around the outer casing 10. More specifically, the bearing base 71 is fixed to the foundation F to support the rotor bearings 70 on the foundation F. In this manner, in the present embodiment, the rotor bearings 70 are directly supported on the foundation F by the bearing base 71, not by the outer casing 10. Therefore, a height of the turbine rotor 2 is positioned at a height based on the foundation surface (the upper surface of the foundation F).

Hereinafter described is functions and effects of the present embodiment having such an arrangement.

In operation of the steam turbine 1, the internal space of the outer casing 10 is caused by the condenser to be in a vacuum state so that the outer casing 10 deforms to recess inward.

However, in the present embodiment, the beam end portions 51 of the supporting beams 50 that support the inner casing 40 are supported by the corresponding supporting surfaces 35 of the first foot plates 34 provided to the lower half end plates 31 of the outer casing lower half 30. Accordingly, the inner casing 40 can be supported by the foundation F without involving the body of outer casing upper half 22 and the lower half body plates 32 of the outer casing lower half 30. Therefore, even when the outer casing 10 deforms due to a vacuum load, the inner casing 40 is not affected by the deformation of the outer casing 10.

The rotor bearings 70 according to the present embodiment are supported by the foundation F through the bearing base 71. Accordingly, the rotor bearings 70 can be supported by the foundation F, not by the outer casing 10. Therefore, the turbine rotor 2 is not affected by the deformation of the outer casing 10 due to the vacuum load. In addition, since the rotor bearings 70 are supported by the foundation F, the outer casing 10 will not receive a load from the turbine rotor 2.

In this manner, neither the inner casing 40 nor the turbine rotor 2 is affected by the deformation of the outer casing 10 due to the vacuum load and by the deformation of the outer casing 10 due to the load from the turbine rotor 2. Accordingly, a position of the inner casing 40 and a position of the turbine rotor 2 do not fluctuate. Therefore, it is possible to reduce the gap between the rotary unit and the stationary unit, and to maintain the gap between the rotary unit and the stationary unit regardless of a state of operation.

Furthermore, in operating the steam turbine 1, a temperature inside the outer casing 10 rises or falls as compared with the temperature during installation, which may lead to thermal expansion or thermal contraction of the supporting beams 50. In particular, in low load operation, the temperature of the internal space of the outer casing 10 may rise in comparison with the temperature during installation.

Figure 6:
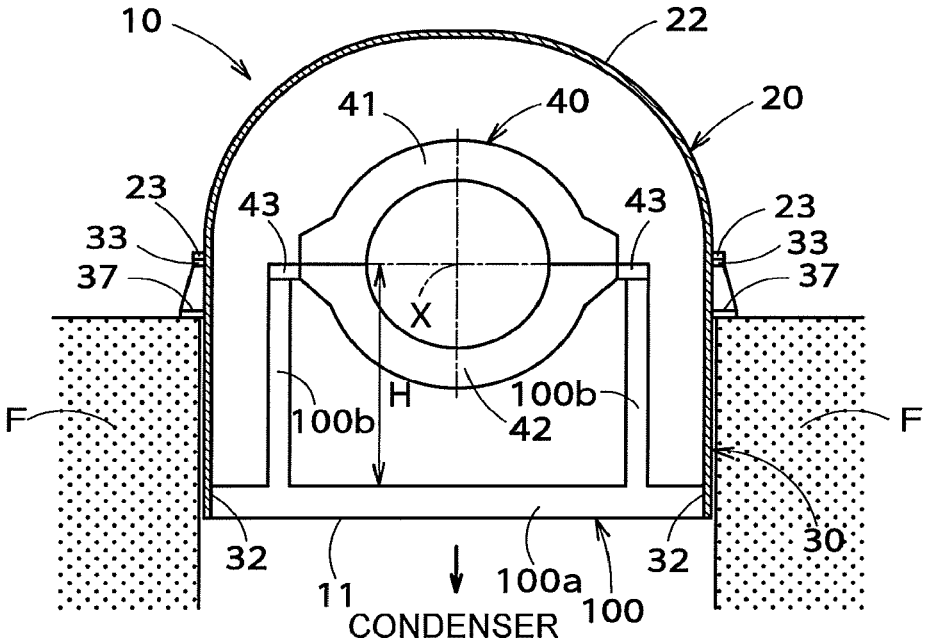
FIG. 6 is a cross-sectional side view illustrating a steam turbine according to a comparative example.

In a typical steam turbine illustrated herein as a comparative example, the inner casing 40 is supported by a bottom supporting member 100 as illustrated in FIG. 6. The bottom supporting member 100 includes a transverse beam 100*a* extending in a horizontal direction from a lower end of the outer casing lower half 30; and a vertical beam 100*b* extending upward from the transverse beam 100*a*. The arms 43 of the inner casing 40 are placed on an upper surface of the vertical beam 100*b*. Both ends of the transverse beam 100*a* are supported by lower ends of the lower half body plates 32 of the outer casing lower half 30. In this case, the bottom supporting member 100 includes the vertical beam 100*b*, and a distance H in the vertical direction between the shaft center line X of the turbine rotor 2 and the lower ends of the lower half body plates 32 is long. Accordingly, the inner casing 40 is displaced upward due to the thermal expansion, which may lead to a difficulty in maintaining a gap in the vertical direction between the rotary unit and the stationary unit.

However, as illustrated in FIGS. 2 and 3, the supporting beams 50 according to the present embodiment support the arms 43 provided to the upper end of the inner casing lower half 42 and extends in the axial direction of the turbine rotor 2. The supporting beams 50 are supported by the foundation F through the first foot plates 34 disposed in upper parts of the lower half end plates 31, and a distance in the vertical direction between a height of the shaft center of the turbine rotor 2 and the foundation surface is short. Accordingly, the inner casing 40 is rarely displaced upward due to the thermal expansion. Therefore, it is possible to reduce the vertical gap between the rotary unit and the stationary unit, and to maintain the vertical gap between the rotary unit and the stationary unit regardless of a state of operation.

According to the present embodiment, regardless of a state of operation, it is possible to maintain the position of the inner casing 40 and the position of the turbine rotor 2 adjusted at the time of installation. Therefore, it is possible to reduce the gap between the rotary unit and the stationary unit so as to reduce detriment attributable to steam leakage. Thus, performance of the turbine can be improved.

Furthermore, since the beam end portions 51 of the supporting beam 50 according to the present embodiment can slide on the supporting surfaces 35 in the axial direction of the turbine rotor 2, it is possible to absorb the deformation of the supporting beams 50 due to the thermal expansion or thermal contraction. For example, when the beam end portions 51 are unable to slide on the supporting surfaces 35, the supporting beams 50 deform in the vertical direction due to the thermal expansion of the supporting beams 50, which may lead to displacement of the inner casing 40 in the vertical direction. On the other hand, according to the present embodiment, the beam end portions 51 can slide on the supporting surfaces 35 so that the deformation of the supporting beams 50 can be absorbed, which does not cause the displacement of the inner casing 40 in the vertical direction. Therefore, it is possible to maintain the vertical gap between the rotary unit and the stationary unit. In particular, in the present embodiment, the low friction member 60 is interposed between each beam end portion 51 of the supporting beams 50 and the corresponding supporting surface 35. Accordingly, it is possible to reduce friction between the beam end portions 51 and the supporting surfaces 35 and to smoothly slide the beam end portions 51 on the supporting surfaces 35. Therefore, the deformation of the supporting beams 50 can be absorbed efficiently.

Figure 7:
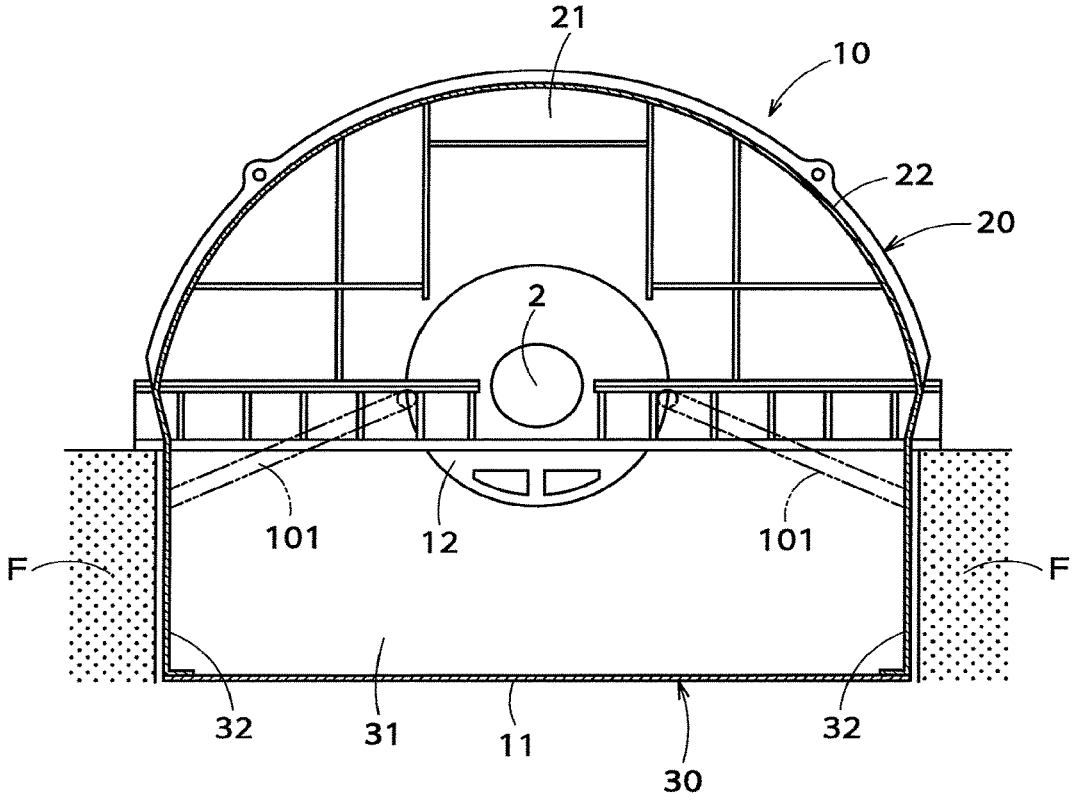
FIG. 7 is a cross-sectional side view illustrating an arrangement of an outer casing of the steam turbine according to the comparative example.

As described above, the rotor bearings 70 according to the present embodiment is supported by the foundation F through the bearing base 71. Accordingly, as illustrated in FIG. 7, pipe stays 101 used for supporting the bearing base 71 on the cones 12 of the outer casing 10 may not be required. In other words, regarding the typical steam turbine illustrated in FIG. 7 as a comparative example, in a case where the bearing base 71 is supported on the cones 12, the pipe stays 101 are provided to reinforce the cones 12 and to secure rigidity. These pipe stays 101 connect the cones 12 and the lower half body plates 32. In contrast, according to the present embodiment, the bearing base 71 is supported by the foundation F so that such pipe stays 101 may not be required. Therefore, it is possible to reduce a pressure loss of a steam flow flowing through each turbine stage 5 toward the lower exhaust outlet 11. Furthermore, the arrangement of the outer casing 10 can be simplified.

Figure 8:
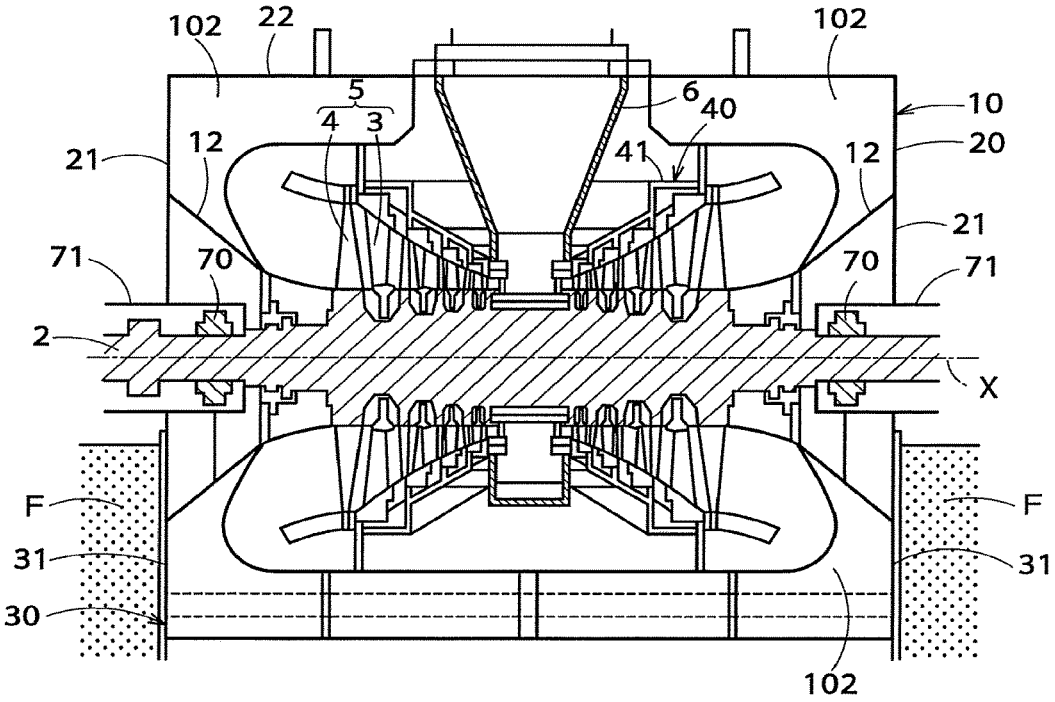
FIG. 8 is a vertical cross-sectional view illustrating a general arrangement of the steam turbine according to the comparative example.

In the typical steam turbine, in order to prevent the deformation of the outer casing 10 due to the vacuum load, a plurality of ribs 102 for reinforcement is provided to the inner surface of the outer casing 10 as illustrated in FIG. 8. Since such ribs 102 are formed, protruding toward the internal space of the outer casing 10, these ribs 102 obstruct part of the steam flow flowing through each turbine stage 5 toward the lower exhaust outlet 11, which may increase the pressure loss. However, in the present embodiment, since the inner casing 40 is not affected by the deformation of the outer casing 10, such ribs 102 may not be required, or the number and size of the ribs 102 may be reduced. Accordingly, it is possible to prevent the steam flow from being obstructed and to reduce the pressure loss, which leads to improvement in the performance of the turbine.

In the present embodiment, the rotor bearings 70 are described to be supported by the foundation F through the bearing base 71. However, the present invention is not limited to this embodiment. As long as the cones 12 of the outer casing 10 have rigidity for sure, the rotor bearings 70 may be supported by the cones 12.

Furthermore, in the present embodiment, the outer casing supporting portions that support the outer casing 10 on the foundation F are described to be the first foot plates 34 provided to the lower half end plate 31 of the outer casing lower half 30. However, the outer casing supporting portion may be a portion other than the first foot plate 34 as long as it supports the outer casing 10 on the foundation F.

Still further, in the present embodiment, the beam end portions 51 on both sides of the supporting beams 50 are described to be placed on the supporting surfaces 35 of the first foot plates 34, being slidably disposed on the supporting surfaces 35 in the axial direction of the turbine rotor 2. However, the present invention is not limited to this embodiment.

For example, when a starting point of extension of the turbine rotor 2 is set outside the steam turbine 1, the center in the axial direction of the turbine rotor 2 within the steam turbine 1 may not accord with the center of the outer casing 10 in the axial direction. In this case, among the beam end portions 51 on both sides of the supporting beams 50, the beam end portion 51 on a side close to the starting point may be unslidably supported on the corresponding supporting surface 35. Accordingly, it is possible to extend the supporting beams 50 and the turbine rotor 2 in the same direction. Furthermore, decreasing a gap in the axial direction between the rotary unit and the stationary unit leads to improvement in work efficiency of the steam.

On the other hand, when the starting point of the turbine rotor 2 is set close to the center in the axial direction of the turbine rotor 2 in the steam turbine 1, as in the present embodiment, it is preferable that the beam end portions 51 on both sides are disposed slidably on the corresponding supporting surface 35. Thus, the supporting beams 50 and the turbine rotor 2 can be made to extend in the same direction on both sides of the inner casing regulating portions 44 in the axial direction of the turbine rotor 2 so that it is possible to reduce the gap in the axial direction between the rotary unit and the stationary unit.

Second Embodiment

Next, a steam turbine according to a second embodiment of the present invention will be described with reference to FIGS. 9 to 11.

Figure 9:
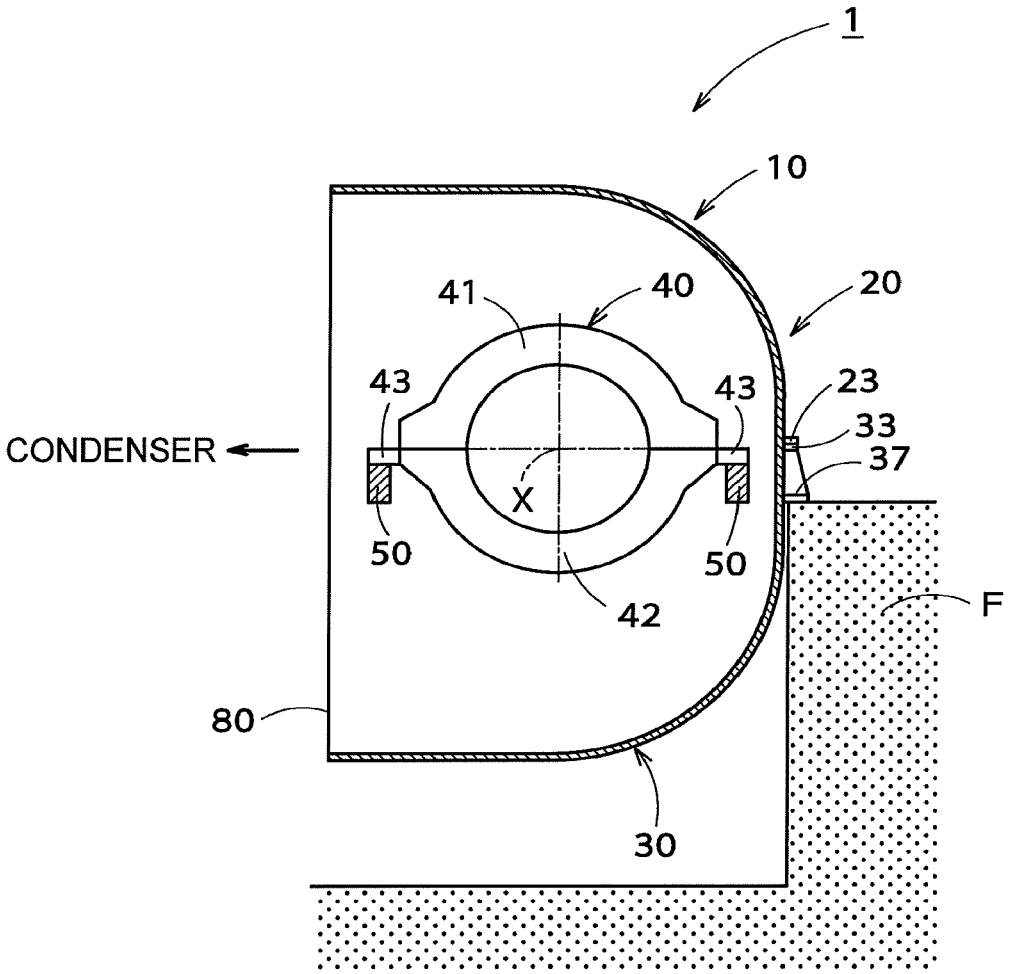
FIG. 9 is a cross-sectional side view illustrating a steam turbine according to a second embodiment.
Figure 10:
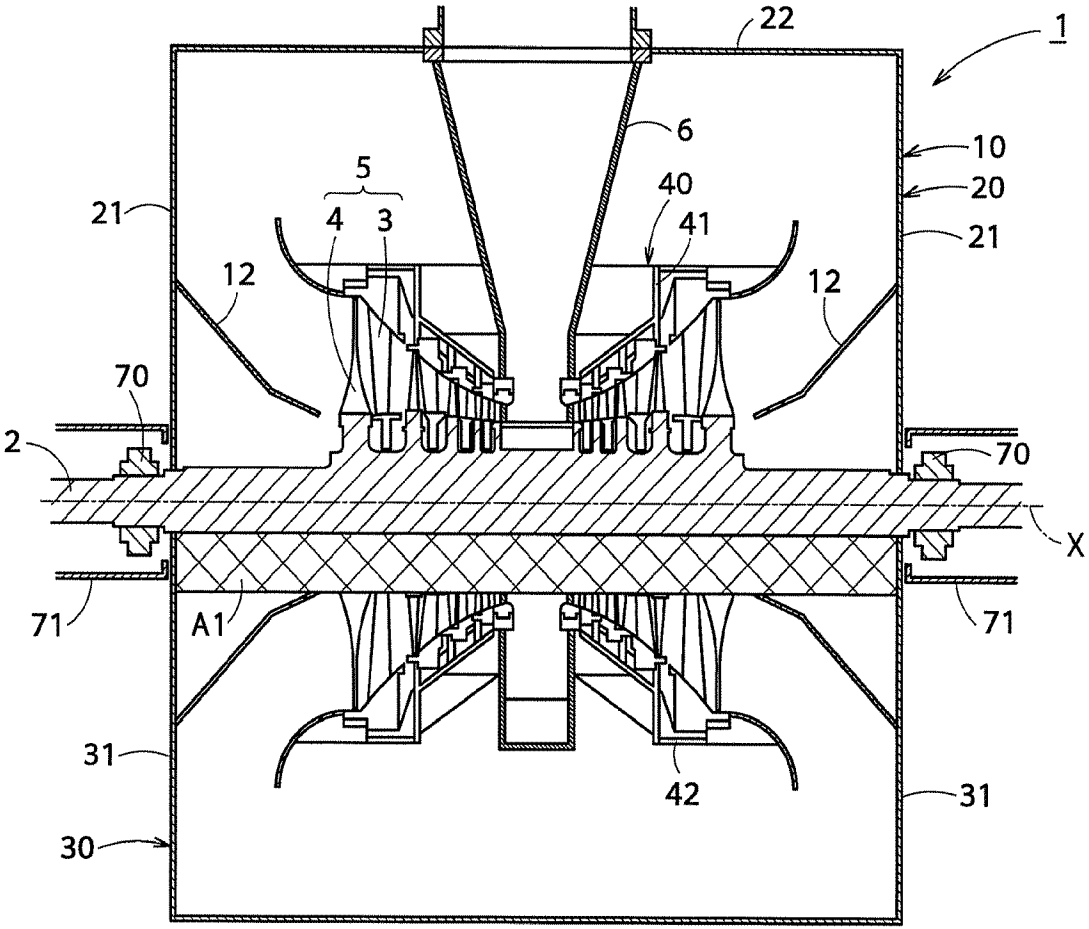
FIG. 10 is a vertical cross-sectional view illustrating a projected area of a supporting beam illustrated in FIG. 9.
Figure 11:
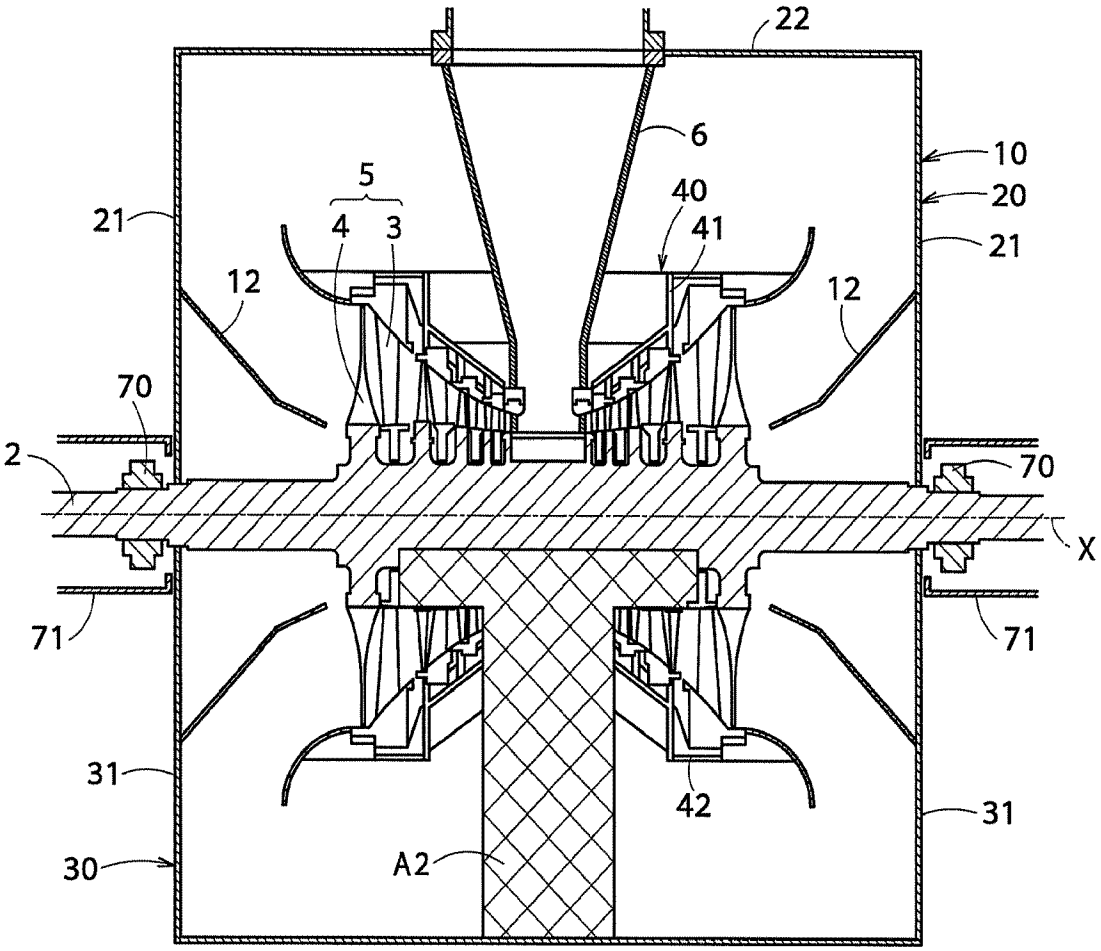
FIG. 11 is a vertical cross-sectional view illustrating a projected area of a bottom supporting member in a steam turbine according to a comparative example.

The steam turbine according to the second embodiment illustrated in FIGS. 9 to 11 differs in that an outer casing includes a lateral exhaust outlet that is configured to discharge steam laterally. Other arrangement is substantially equivalent to the steam turbine according to the first embodiment illustrated in FIGS. 1 to 8. In FIGS. 9 to 11, the same parts as those of the first embodiment illustrated in FIGS. 1 to 8 are denoted by the same reference numerals, and a detailed description thereof will be omitted.

As illustrated in FIG. 9, a steam turbine 1 according to the present embodiment is a lateral exhaust turbine. In other words, an outer casing 10 includes a lateral exhaust outlet 80 provided to a lateral end of the outer casing 10. The steam that has passed through each turbine stage 5 flows through the inside of the outer casing 10 toward the lateral exhaust outlet 80 so as to be discharged from the lateral exhaust outlet 80. The steam discharged from the lateral exhaust outlet 80 is supplied to a condenser (not illustrated) coupled to the steam turbine 1.

A second foot plate 37 according to the present embodiment is disposed on one side with respect to a shaft center line X of a turbine rotor 2 as viewed from above. In other words, the second foot plate 37 is disposed on a side opposite to the lateral exhaust outlet 80.

Herein, FIG. 10 illustrates a projected area A1 of supporting beams 50 according to the present embodiment. As a comparative example, FIG. 11 illustrates a projected area A2 of a bottom supporting member (not illustrated) that supports an inner casing 40 of a typical lateral exhaust turbine. The projected areas A1, A2 herein represent areas in which the supporting beams 50 or the bottom supporting member is projected perpendicularly to a perpendicular plane formed by the lateral exhaust outlet 80.

As illustrated in FIG. 11, the bottom supporting member as a comparative example extends from a lower end of an outer casing lower half 30 to arms 43 of an inner casing lower half 42. Accordingly, this bottom supporting member obstructs part of a steam flow flowing through each turbine stage 5 toward a lateral exhaust outlet 80, which may increase a pressure loss. In other words, as can be seen in FIG. 11, the projected area A2 of the bottom supporting member accounts for a relatively large region in the entire region of the lateral exhaust outlet 80. In the entire region of the lateral exhaust outlet 80, an increase in a proportion of a region which the projected area A2 accounts for tends to increase loss in a steam flow. Therefore, using the bottom supporting member as a comparative example may increase the loss in the steam flow. Particularly, in such an arrangement of the bottom supporting member, thickening the bottom supporting member is efficient to improve rigidity of the bottom supporting member. However, in this case, the projected area A2 increases, which may further increase the loss in the steam flow.

In contrast, as illustrated in FIG. 10, the supporting beams 50 according to the present embodiment can reduce the projected area A1. Therefore, it is possible to reduce a proportion of a region which the projected area A1 accounts for in the entire region of the lateral exhaust outlet 80, and it is possible to reduce the loss in the steam flow.

According to the present embodiment, the inner casing 40 is supported by the supporting beams 50 extending in an axial direction of the turbine rotor 2, and the beam end portions 51 of the supporting beams 50 are supported by supporting surfaces 35 of first foot plates 34. Accordingly, the inner casing 40 can be supported by the foundation F without involving the body of outer casing upper half 22 and the lower half body plates 32 of the outer casing lower half 30. Therefore, even when the outer casing 10 deforms due to a vacuum load, the inner casing 40 is not affected by the deformation of the outer casing 10, and the inner casing 40 is not displaced. In other words, according to the present embodiment, regardless of a state of operation, it is possible to maintain a position of the inner casing 40 and a position of the turbine rotor 2 adjusted at the time of installation. Therefore, it is possible to reduce the gap between the rotary unit and the stationary unit so as to reduce detriment attributable to steam leakage. Thus, performance of the turbine can be improved.

According to the present embodiment, in the steam turbine 1 serving as the lateral exhaust turbine, the foundation F is not provided to a part of the outer casing 10 in a side close to the lateral exhaust outlet 80 as illustrated in FIG. 9. Even in this case, however, the beam end portions 51 of the supporting beams 50 can be supported by the foundation F disposed outside a lower half end plate 31, involving the first foot plates 34. Therefore, it is possible to preferably support the inner casing 40 of the steam turbine 1. In addition, even in a case where condensers are disposed on both sides of the steam turbine 1 without the foundation F being provided, the inner casing 40 can be preferably supported by the supporting beams 50.

In the present embodiment, the inner casing 40 is described to be supported by the pair of supporting beams 50. However, the present invention is not limited to this example. The inner casing 40 may be supported by one supporting beam 50, and this supporting beam 50 may be disposed in a side close to the lateral exhaust outlet 80 (left side in FIG. 9). In this case, a supporting member (not illustrated) having any shape may be used in the side opposite to the lateral exhaust outlet 80. Even in this case, it is possible to prevent the inner casing 40 from being affected by the deformation of the outer casing 10, and to prevent displacement of the inner casing 40.

According to the aforementioned embodiment, it is possible to reduce the gap between the rotary unit and the stationary unit so as to reduce the detriment attributable to steam leakage, thereby improving the performance of the turbine.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Further, it will be understood that these embodiments can be at least partially combined properly without departing from the spirit of the present invention.

The invention claimed is:

1. A steam turbine provided on a foundation, the steam turbine comprising:

an outer casing;

an inner casing housed inside the outer casing;

a turbine rotor penetrating the inner casing and the outer casing; and a supporting beam provided inside the outer casing, the supporting beam extending in an axial direction of the turbine rotor and being configured to support the inner casing, wherein the outer casing includes outer casing supporting portions that are provided at both ends of the outer casing in the axial direction and are supported by the foundation, and the supporting beam includes beam end portions provided at both ends in the axial direction, wherein each of the outer casing supporting portions includes a supporting surface that supports the corresponding beam end portion.

2. The steam turbine according to claim 1, wherein the outer casing includes first end walls facing the corresponding beam end portion in the axial direction, wherein a gap is provided between each of the beam end portions of the supporting beam and the corresponding first end wall.

3. The steam turbine according to claim 1, wherein the outer casing includes a pair of second end walls facing the corresponding beam end portion in a direction orthogonal to the axial direction as viewed from above, wherein a gap is provided between each of the beam end portions of the supporting beam and the corresponding second end wall.

4. The steam turbine according to claim 1, wherein a low friction member is interposed between each of the beam end portions of the supporting beam and the corresponding supporting surface.

5. The steam turbine according to claim 1, further comprising:

a rotor bearing rotatably supporting the turbine rotor; and a bearing base supporting the rotor bearing on the foundation.

6. The steam turbine according to claim 1, wherein the supporting beam is restricted to move in the axial direction with respect to a central part of the inner casing in the axial direction.

7. The steam turbine according to claim 1, wherein the outer casing includes a lower exhaust outlet that is provided at a lower end of the outer casing and is configured to discharge steam downward, and the inner casing is supported by a pair of supporting beams, wherein the supporting beams are disposed on both sides with respect to a shaft center line of the turbine rotor as viewed from above.

8. The steam turbine according to claim 1, wherein the outer casing includes a lateral exhaust outlet which is provided at a lateral end of the outer casing and is configured to discharge steam laterally, and the supporting beam is disposed on a side close to the lateral exhaust outlet with respect to a shaft center line of the turbine rotor.

* * * * *